US006622453B2

(12) United States Patent
Dove

(10) Patent No.: US 6,622,453 B2
(45) Date of Patent: Sep. 23, 2003

(54) TOOLING AND METHOD FOR APPLICATION OF A TEXTURED CEILING AND FOR REMOVAL OF ACOUSTICAL CEILING

(76) Inventor: Michael J. Dove, 24115 Lindley St., Mission Viejo, CA (US) 92691

( * ) Notice: Subject to any disclaimer, the term of this patent is extended or adjusted under 35 U.S.C. 154(b) by 123 days.

(21) Appl. No.: 09/816,192

(22) Filed: Mar. 26, 2001

(65) Prior Publication Data

US 2002/0134044 A1 Sep. 26, 2002

(51) Int. Cl.[7] ..... E04D 15/00

(52) U.S. Cl. ..... 52/749.1; 52/DIG. 1; 52/745.06; 15/105; 15/145; 15/236.01; 81/489

(58) Field of Search ..... 52/749.1, 745.05, 52/DIG. 1, 745.06; 15/236.01, 145, 105, 106, 111, 159.1; 81/489, 491, 45, 46; 451/350, 354

(56) References Cited

U.S. PATENT DOCUMENTS 2,860,361 A * 11/1958 Moody ..... 15/106
4,853,042 A * 8/1989 Widerman, Jr. ..... 134/6
5,047,089 A * 9/1991 Grant ..... 134/21
5,218,733 A * 6/1993 Leu ..... 15/146
5,220,704 A * 6/1993 Flynn et al. ..... 15/321
5,261,144 A * 11/1993 Mitchell et al. ..... 15/235.4
5,502,857 A * 4/1996 Jubinville ..... 15/111
5,699,574 A * 12/1997 Oviatt ..... 15/210.1
5,951,781 A * 9/1999 Lucas ..... 134/6
6,101,663 A * 8/2000 Greer, Jr. et al. ..... 15/236.01
6,442,784 B1 * 9/2002 Bilger ..... 15/111

* cited by examiner

*Primary Examiner*—Carl D. Friedman
*Assistant Examiner*—Jennifer I. Thissell
(74) *Attorney, Agent, or Firm*—Edward E. Roberts

(57) ABSTRACT

A unique, clean, fast and low cost method for the application of a textured ceiling, and if necessary the removal of acoustical ceiling, including improved tooling that does not include the use of ladders, scaffolding or other such dangerous structures. The tooling includes a unique changeable tool holder for readily exchanging the tools required, such as a ceiling scraping tool, ceiling brush, texture application pad, and spreading blade. Improved means for isolating the work area are disclosed.

14 Claims, 6 Drawing Sheets

TOOLING AND METHOD FOR APPLICATION OF A TEXTURED CEILING AND FOR REMOVAL OF ACOUSTICAL CEILING

RELATED APPLICATION

The applicant is the inventor of the invention shown, described and claimed in utility patent application Ser. No. 09/494,448 filed Jan. 31, 2000, and entitled "METHOD AND APPARATUS FOR REMOVING ACOUSTICAL CEILING AND REPLACEMENT THEREOF WITH TEXTURED CEILING".

BACKGROUND OF THE INVENTION

The background of the invention will be discussed in two parts.

1. Field of the Invention

This invention relates to apparatus for the process of applying a textured ceiling that includes, if necessary, the removal of acoustical ceiling, and more particularly to improved tooling providing for a faster, cleaner and less expensive process.

2. Description of the Prior Art

Textured ceilings are common in the building industry and have become quite popular during renovation and remodeling, especially during remodeling of older residences. In such instances, it is often necessary that an existing acoustical ceiling must first be removed before applying the new textured ceiling Prior art methods of both the application of a textured ceiling, and where necessary, removal of acoustical ceiling, have been cumbersome, messy, labor extensive and time consuming. For example, the application of a textured ceiling generally is by use of compressed air guns that are extremely messy by nature. Additionally, in the removal of acoustical ceiling, common hand-held putty knifes have been used as ceiling scrapers which necessitate the use of such structures as "A" frame ladders, scaffolding, and even stilts, to reach the ceiling. Use of such ladders, scaffolding or stilts is time consuming in set-up and relocation. Further, such means are dangerous due to the necessity for working above the floor in a commonly slippery area to access the ceiling.

Additionally, the use of such conventional methods in application of a textured ceiling, and as is usually the case in renovation of older residencies, the removal of an existing acoustical ceiling, generally results in excessive contamination of the work area as well as areas adjacent to the work area. Also, the use of such conventional methods is unnecessarily labor extensive, which thus increases time for job completion. As an example, use of these conventional methods, when coupled with corresponding necessary clean up, commonly takes 3–5 days for a typical residence. The same process in accordance with the apparatus and method of the present invention commonly takes no more than one day for the typical residence.

Thus, prior art procedures are unsatisfactory in that they are comparatively inefficient, time consuming, expensive and dangerous. Accordingly, it is a feature of this invention to provide improved apparatus, and method of use thereof, for both the application of textured ceiling, and where necessary the removal of existing acoustical ceiling, that is comparatively more quick, clean, less expensive, and safer for the workers than conventional methods

SUMMARY OF THE INVENTION

The invention provides improved tooling and method of use thereof for the application of a textured ceiling, and if necessary, the removal of acoustical ceiling. Use of the tooling as described does not include the use of ladders, scaffolding or other such dangerous structures In accordance with the invention, improved tooling having handle extension means is used to enable the user to access the ceiling while standing on the floor beneath the ceiling. In applying a textured ceiling, a spreading tool is first used to apply thin amounts of drywall "mud" to cover exposed drywall tape joints and other flaws. An application pad is then used to apply the new texture, such as a coat of drywall "mud", to the ceiling. The texture is then spread over the ceiling as desired with the use of the spreading tool. If desired, the texture applicator can have surface means thereon for applying a design to the ceiling.

When removal of acoustical ceiling is desired, the area is first moisturized, by application of a fine mist of water, to loosen the ceiling including any clinging debris. The loosened ceiling and debris is then removed with an improved scraping tool, after which an improved ceiling brush is used to further clean the ceiling and to prepare it for readily accepting the new ceiling texture material. Both the scraping tool and ceiling brush embody handle extension means The scraping tool, ceiling brush, spreading knife, and texture applicator are specially designed to perform their respective functions. As more completely explained below, there is provided universal mating means for easy acceptance, and replacement, of the improved tooling apparatus so as to optimize their use in performance of their respective work functions.

It is thus an aspect of the invention to provide improved tooling for application of a textured ceiling, and where desired removal of acoustical ceiling, that is comparatively more quick, clean, less expensive, and safer for the workers than conventional methods.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

The preferred embodiment of the tooling in accordance with the invention is described while referring to designated figures of the drawings, and relates to specialized tooling for an improved process of applying a textured ceiling and, if necessary, the removal of an existing acoustical ceiling. The improved tooling and method of use provides for a faster, cleaner, less expensive and safer process.

Prior to describing the specialized tooling, the method of application of the tooling will be addressed. When applying a textured ceiling, or especially if removing an existing acoustical ceiling, best results are realized when the work area is first sufficiently isolated to protect surrounding areas, as described below, to insure a clean process with minimum escape of ceiling material, moisture, dust, etc.

Figure 6:
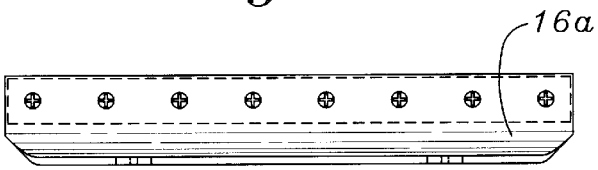
FIG. 6 is a back view of the ceiling brush showing the method of attachment of the brush to the brush mounting plate.
Figure 5:
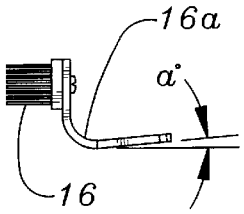
FIG. 5 is an end view of the ceiling brush, in accordance with the invention.
Figure 7:
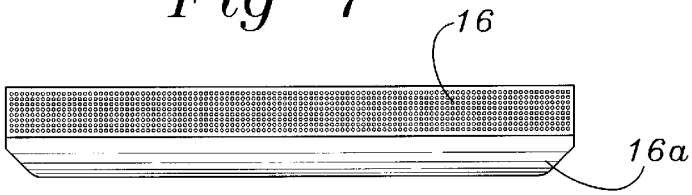
FIG. 7 is a bottom view of the ceiling brush showing the brush bristles as extending across the mounting plate.
Figure 9:
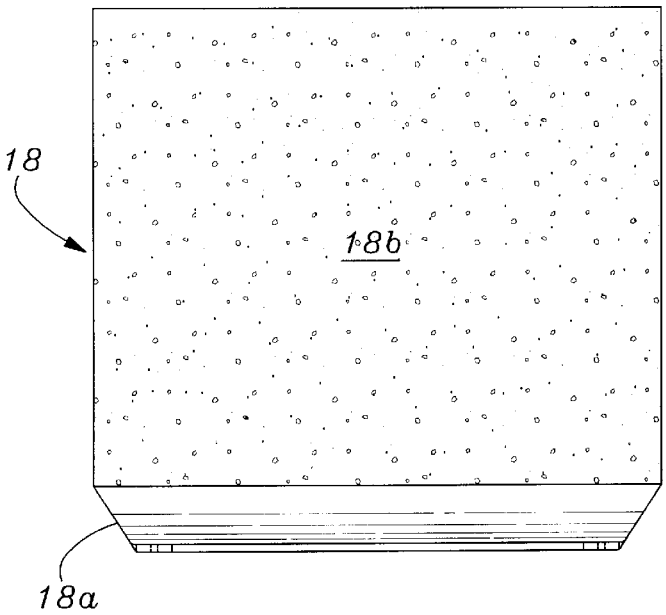
FIG. 9 is a bottom view of the texture application pad.
Figure 8:
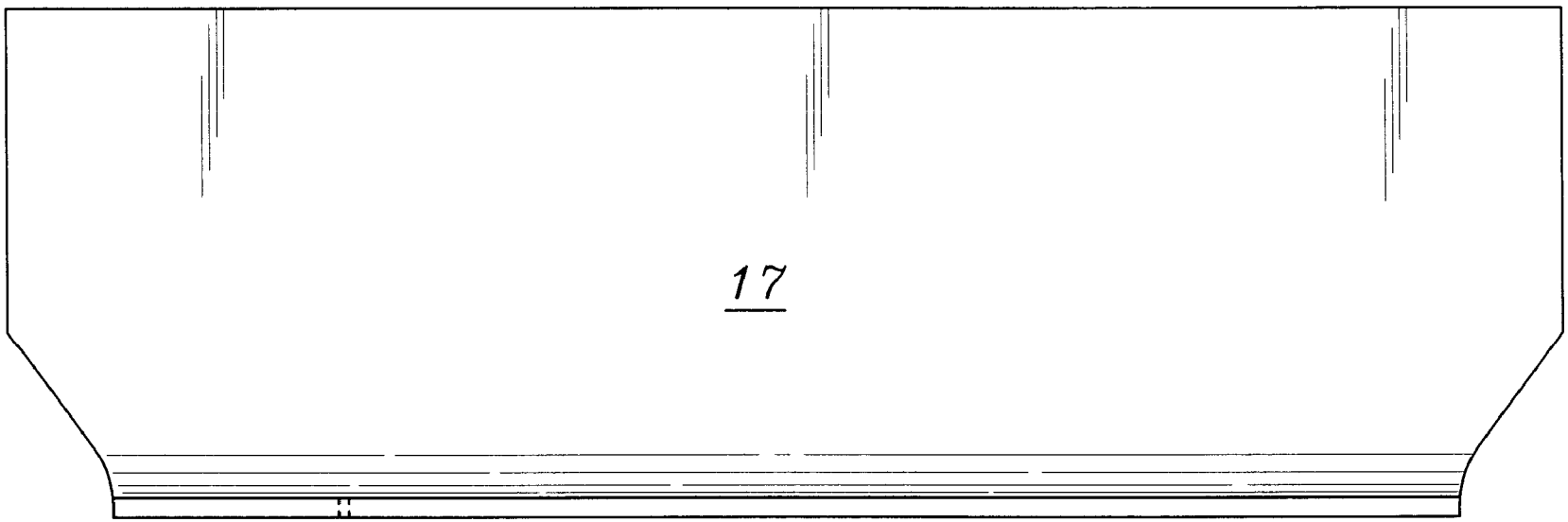
FIG. 8 is a bottom view of the spreading knife in accordance with the invention.

When applying a textured ceiling, and after the work area is isolated from surrounding areas, the ceiling is brushed, or swept, clean with ceiling brush 16 (See FIGS. 5–7). Then, spreading knife 17 (See FIG. 8) is used to apply thin amounts of drywall "mud" to cover all ceiling tape joints and other flaws. Texture application pad 18 (See FIG. 9) is then used to apply a texture coating coat of drywall "mud" to the ceiling. In this step, pad 18 is dipped into a container of "mud" of desired consistency and then pressed firmly against the properly scraped and swept ceiling. Spreading knife 17 is then used as necessary to finish the applied texture.

Although not shown, if desired the face of application pad 18 can be provided with a pattern that can be transferred to the ceiling upon pressing of the patterned pad against the ceiling When it is desired to remove an acoustical ceiling, the ceiling is first moistened with a fine spray or mist of water to loosen the acoustical material and any accumulated debris. It has been found satisfactory to use a high-pressure (300-psi) construction grade water hose having attached thereto a garden type adjustable spray nozzle. The nozzle is adjusted to provide a fine spray or mist that loosens the ceiling material while decreasing any contaminants, such as dust, from being blown from the ceiling.

After the acoustical material is sufficiently moistened, the ceiling is scraped with scraper tool 13 (See FIG. 1) and then swept with ceiling brush 16 to remove any remaining acoustical material and associated debris. This prepares the ceiling for accepting the new texture material as described above. After completion of the ceiling renovation, the means for protecting areas adjacent to the work area is detached, collected to contain the debris resulting from the ceiling project and removed from the work area.

Figure 1:
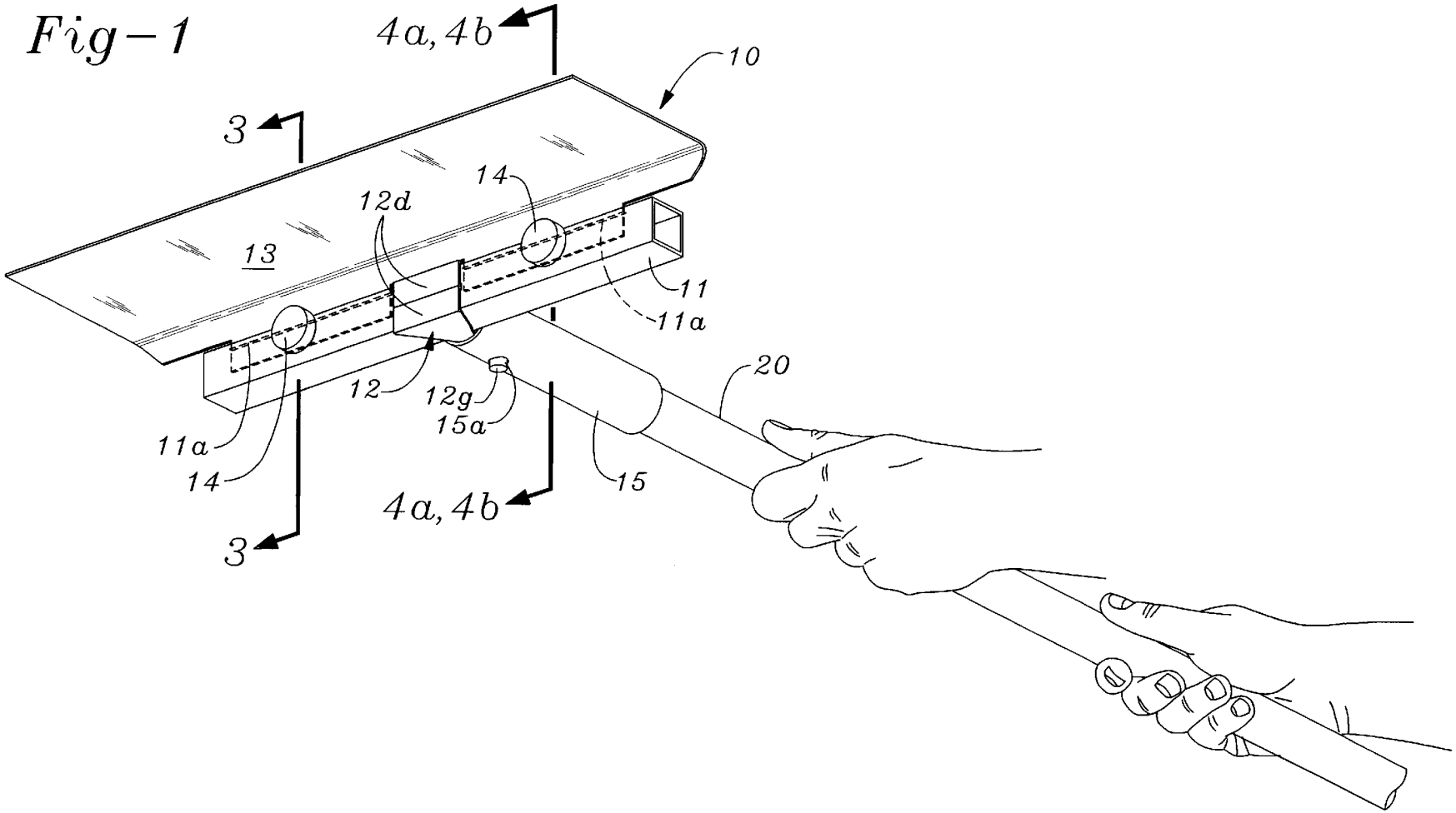
FIG. 1 is a perspective view of specialized tooling in accordance with the invention assembled for use and showing the combination of the tool holder, handle bracket, tool locking means, handle bracket sleeve, and a first embodiment of the apparatus tool.
Figure 2:
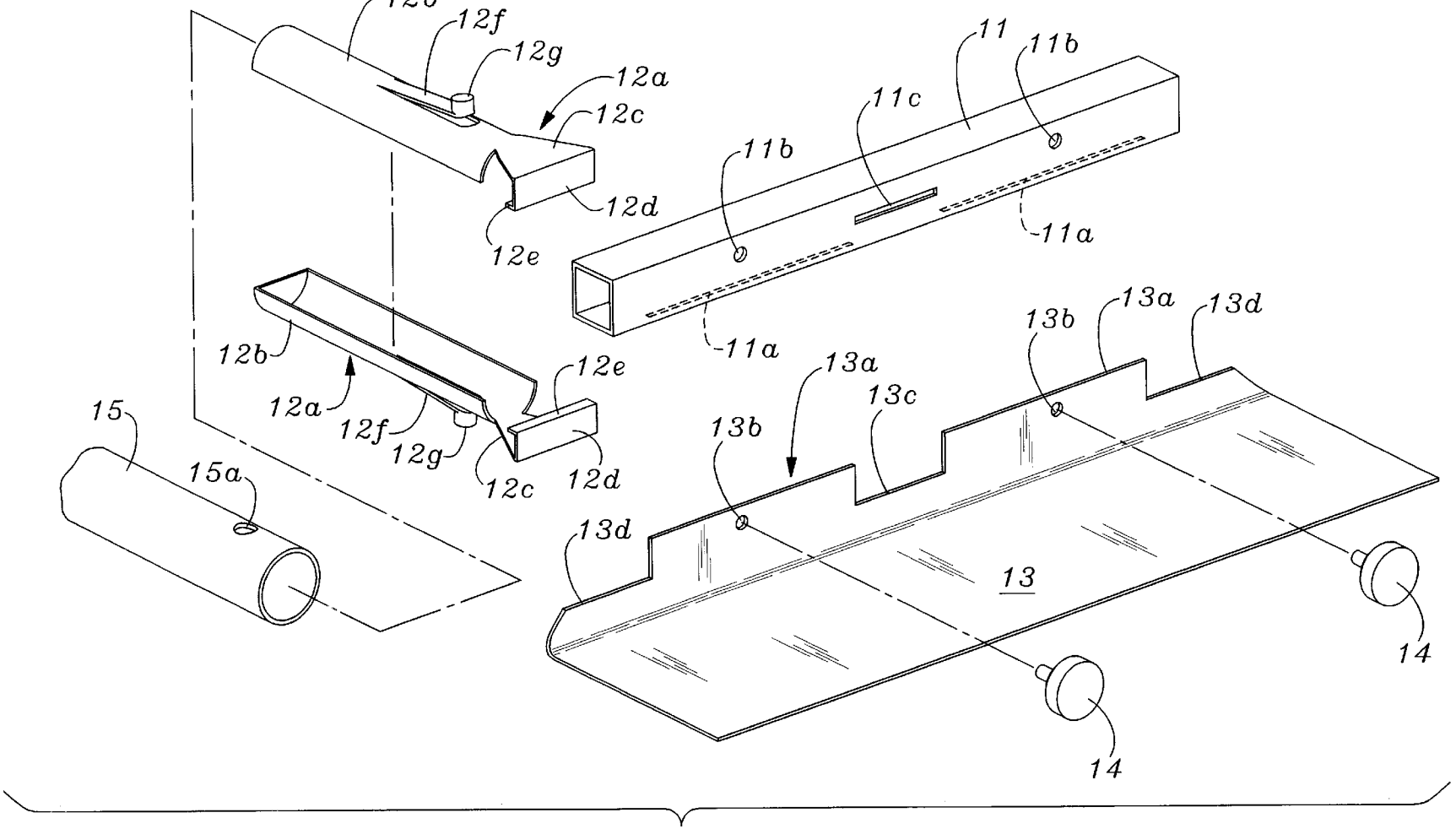
FIG. 2 is an exploded view of the specialized tooling of FIG. 1.

Referring now to the drawings, and more particularly to FIGS. 1 and 2, there is shown, generally designated 10, the assembled combination of the tool holder 11, handle bracket 12 composed of two identical halves generally designated 12*a*, apparatus tool 13, tool locking knobs 14, and handle bracket sleeve 15

Figure 3:
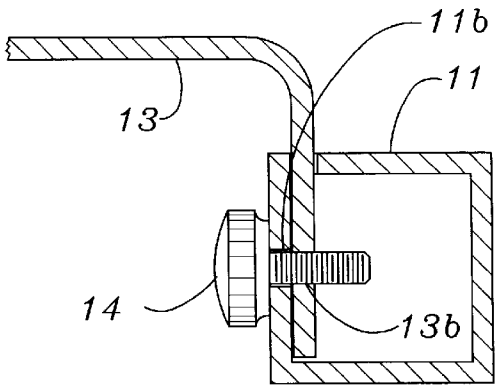
FIG. 3 is a partial sectional view showing the tool holder, apparatus tool, and tool locking means of FIG. 1, taken along lines 3—3 of FIG. 1.

Tool holder 11 is of an elongated, hollow, substantially square, both inside and outside, configuration with generally planar surfaces. Tool holder 11 can satisfactorily be constructed of stamped, bent, and welded anodized aluminum. As shown in FIG. 2, two longitudinal slots 11*a* are shown in dotted lines on the underside of holder 11 for receiving the two upturned portions 13*a* of tool 13 Tool 13 is positioned in holder 11 as shown in FIGS. 1 and 3 such that non-threaded holes 11*b* of holder 11 match up with threaded holes 13*b* of tool 13 when upturned, or curved, tool portions 13*a* are fully inserted through slots 11*a*. Tool 13 has two cutouts 13*d* to permit insertion of upturned portions 13*a* sufficiently into holder 11 to align holes 11*b* and 13*b*

Tool 13 is then secured to tool holder 11, as indicated in FIG. 3, by means of threaded knobs 14 passing through non-threaded holes 11*b* and securely threaded into threaded holes 13*b* to thereby effect a secure and firm attachment of the tool 13 to tool holder 11.

Tool holder 11 is secured to tool handle 20 by means of handle bracket 12 and sleeve 15 As seen in FIG. 2, handle bracket 12 is comprised of two identical halves, generally designated 12*a*, each of which include semi-circular portions 12*b*, hook means comprised of planar portions 12*c*, 12*d*, and 12*e*, and finger 12*f* including locking tab 12*g*. When hook portions 12*e* of halves 12*a* are hooked onto slot 11*c* of tool holder 1, joined together as a cylindrical unit, and partially encompassed by sleeve 15, tool holder 11 and bracket 12 become securely locked together and function as one single unit. Tool 13 has a cutout 13*c* between upturned portions 13*a* to permit insertion of hook portions 12*e* into slot 11*c* to capture holder 11.

Handle bracket 12 can be stamped from an appropriate planar metal sheet with semi-circular portions 12*b*, hook means 12*c–e*, and locking tabs 12*g* formed as indicated. The semi-circular portions 12*b* can be formed from the planar metal sheet in a conventional manner. To form appropriate hook means, in each case, planar hook portion 12*d* is bent downwardly from portion 12*c* at 90 degrees in the same direction as semi-circular portion 12*b*, and portion 12*e* is bent rearwardly at 90 degrees from portion 12*d* to be substantially parallel with portion 12*c*

FIG. 12*f* is stamped into the planar metal sheet with the open end, or finger tip, bent upwardly and away from the surface of the sheet to form tab 12*g*. In order to function as locking means as will hereafter be explained, it is necessary that the metal composition of the sheet provides sufficient spring resiliency such that tab 12*g* returns to its original position after depression and release.

Figure 4A:
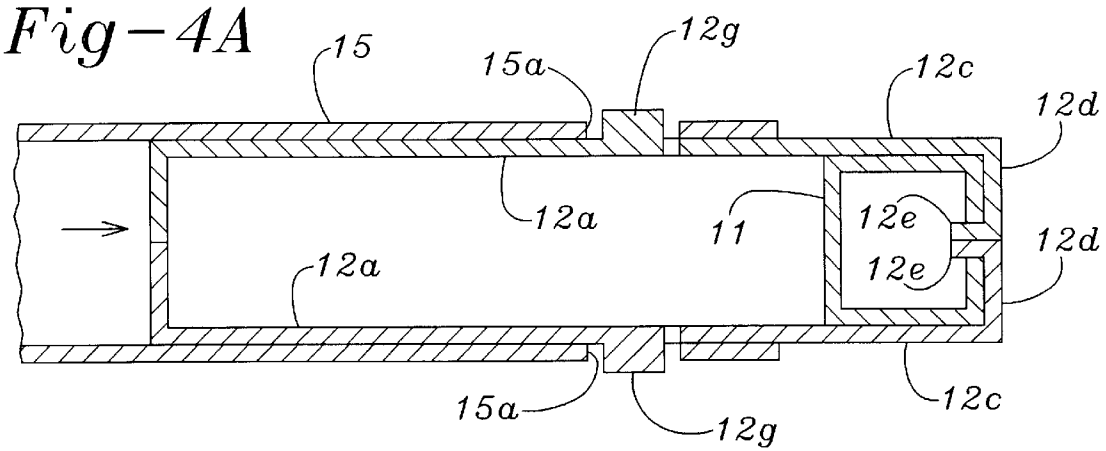
FIG. 4*a* is a sectional view showing positioning of the locking and release tabs for attachment and locking of the bracket sleeve to the handle bracket, taken along lines 4—4 of FIG. 1.
Figure 4B:
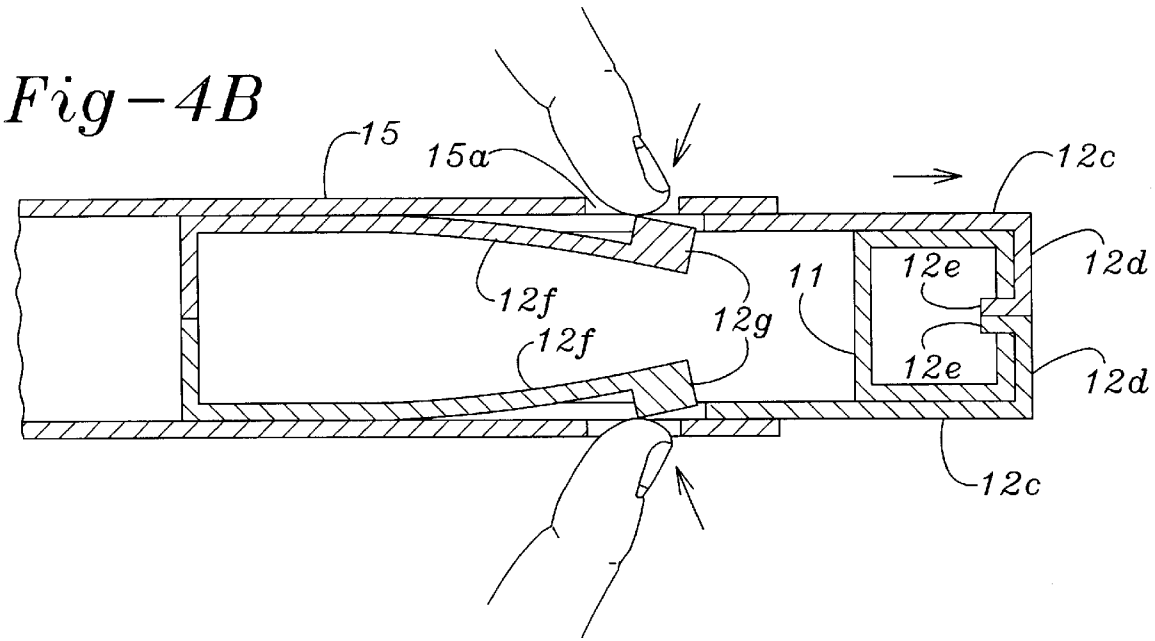
FIG. 4*b* is a sectional view showing operation of the locking and release tabs for releasing the handle bracket from the bracket sleeve.

Bracket sleeve 15 (See FIGS. 1, 2, 4*a* and 4*b*) is typically an aluminum tube having an inside diameter sufficient to slip over semi-circular brackets 12*a* after they have been joined with tool holder 1 and collapsed to form a complete cylindrical unit. In the locking operation collapsed halves 12*a* are positioned in sleeve 15 so that tabs 12*g* fit into and protrude from holes 15*a*, as shown in FIG. 4*a*, thereby securely locking the sleeve 15, tool holder 11, and tool 13 into a single operational unit. To unlock the unit it is only necessary to depress tabs 12*g* and disengage brackets 12*a* from sleeve 15, as indicated in FIG. 4*b*. In this manner the various specialized tools of the invention may be interchanged Sleeve 15 may be an integral portion of handle 20 of a desired length, such as to provide access to the ceiling by a user standing on the floor of the room, or may be affixed a handle of another material in any conventional manner. For instance, a handle may be extendible into various lengths by any conventional means such as sections of tubing having interlocking means such as snap-in spring tabs, or by telescoping tubes as is known in the art As described above, ceiling brush 16 is used to sweep the acoustical debris from the ceiling. An end view of brush 16 is shown in FIG. 5, brush 16 being mounted to base plate 16*a* as indicated in the back view of brush 16 shown in FIG. 6 FIG. 7 is a bottom view of brush 16 showing brush bristles extending across base plate 16*a* Brush 16 has dimensions generally of 1×18 inches. Base plate 16*a* is spring steel of any convenient dimensions.

After the ceiling is brushed clean and it is desired to replace the removed acoustical ceiling with a desired textured ceiling, spreading, or floating, knife 17 (see FIG. 8) is used to apply thin amounts of drywall "mud" to cover all drywall tape joints and other flaws. Spreading knife 17 is made of thin, flexible, hardened steel with dimensions of approximately 6×18 inches, 18 inches being the width of the leading edge. The thickness is generally about 0.020 inches.

Figure 10:
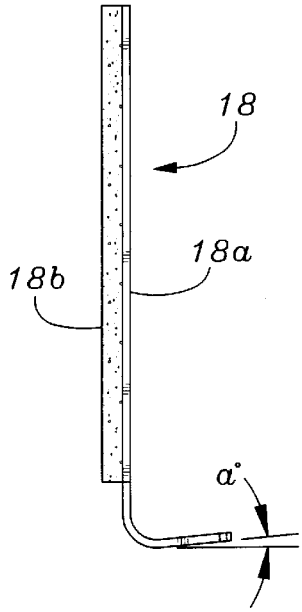
FIG. 10 is a side view of the texture application pad of FIG. 9.

After preparation of the ceiling, texture applicator 18 (FIGS. 9 and 10) is used to apply texture to the ceiling as heretofore described. Pad 18 is comprised of a metal base plate 18*a* to which is added a surface pad 18*b* composed of a high density, light weight, flexible foam material similar to that of the "boogie" board familiar to water sports enthusiasts. Base plate 18*a* is formed of thin, flexible, hardened steel with dimensions of approximately 12×24 inches, 24 inches being the width of the leading edge. The thickness is generally about 0.020 inches. Surface pad 18*b* is added to the surface of plate 18*a* in any conventional manner In the removal of an existing acoustical ceiling, the scraping tool, or blade, 13 is used. Scraping tool 13 is shown attached to tool holder 11 in FIGS. 1 and 2. Blade 13 is generally made from a plate of stiff, smooth surfaced, hardened spring steel, 6×14 inches, 14 inches being the width of the front or leading edge. The thickness of the blade is about 0.028 inches. The combination of stiff hardened material and the smooth surface of blade 13 provide for efficient scraping and removal of the moistened ceiling. After adjusting the handle length as described, the moistened acoustical ceiling is removed by scraping with tool 13 until the drywall joints and the paper of the drywall sheet are exposed. For ceilings having a different pitch, any of the above tools may be manufactured with different "strike angles", that is, the angle of the working surface of the tool with respect to the handle as indicated by the angle $\alpha$ in FIGS. 5 and 10.

An adequate means for protecting areas adjacent to the work area consists of isolating the area with plastic sheeting, applied in a manner to ensure quick and easy clean up of debris. A preferred method includes first sticking sufficient lengths of masking tape, generally a two-inch strip, to select spots on the interior walls with the remainder of such strips not stuck to the wall but left hanging loose toward the floor. A sheet of plastic is then placed under the loose portions of tape and stuck against the respective exposed adhesive sides of the tapes. In order for the tape to properly hold the plastic sheeting in place it is necessary to use sufficiently lightweight sheeting since heavy plastic sheeting will lift the adhesion of the sheeting from the tape. After attachment to the respective tape portions, the remainder of the plastic sheet is placed to lie upon and cover the floor. As required, additional sheets of plastic are cut to fit the dimensions of the other wall surfaces and likewise attached until the protective envelope is completed. The tape portions covering the floor, and other areas as required, such as each corner where plastic has been taped to the wall, are reinforced as necessary to provide the desired protection.

Figure 11:
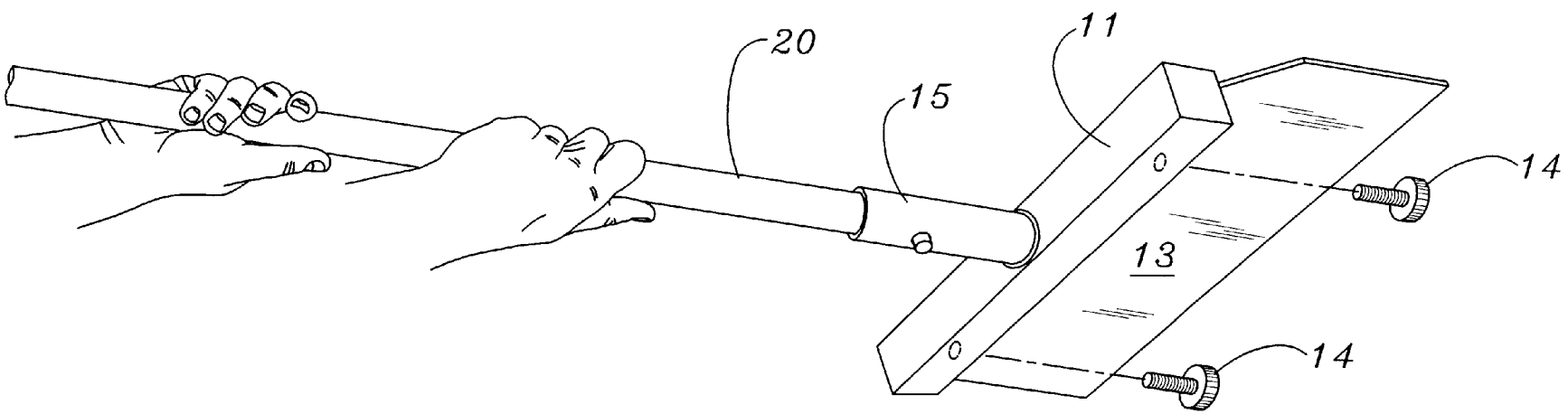
FIG. 11 is a perspective view of an alternate embodiment of the specialized tooling in accordance with the invention.

In accordance with the invention there has been shown and described improved apparatus, and method of use thereof, for the application of a textured ceiling, and if necessary the removal of an acoustical ceiling. It is to be understood that various other adaptations and modifications may be apparent to those skilled in the art and may be made without departing from the spirit and scope of the invention. For instance, FIG. 11 shows an embodiment omitting the bracket 12*a*, sleeve 15 being welded or otherwise connected directly to holder 11

While there has been shown and described a preferred embodiment, the invention is not limited to the specific form as described and illustrated but rather limited only by the literal interpretation of the claims herein.

What is claimed is:

1. Apparatus for renovating a drywall ceiling comprising ceiling tool means for working said ceiling;

a tool holder for interchangeably retaining said tool means;

handle means for a user to utilize said tool means;

means for attachment of said tool holder to said handle including bracket means for removable attachment of said tool means to said holder and a bracket sleeve attached to said handle and having locking means for locking said bracket means to said handle; and wherein said tool holder is of an elongated, hollow, substantially square configuration with generally planar surfaces and includes longitudinal slot means in one of said surfaces for receiving said tool means, and tool retaining means for attaching said tool means to said tool holder.

2. The apparatus of claim 1 wherein said handle is adjustable in length such that a user can stand on the floor beneath the ceiling and, work the ceiling with said ceiling tool means.

3. The apparatus of claim 1 wherein said ceiling tool is a scraping tool for clearing the ceiling of undesirable debris in preparation for application of new ceiling material.

4. The apparatus of claim 1 wherein said ceiling tool is a spreading blade for spreading drywall mud to cover drywall tape joints and other flaws in the ceiling.

5. Apparatus for renovating a drywall ceiling comprising ceiling tool means for working said ceiling;

a tool holder for interchangeably retaining said tool means;

handle means for a user to utilize said tool means;

means for attachment of said tool holder to said handle including bracket means for removable attachment of said tool means to said holder and a bracket sleeve attached to said handle having locking means for locking said bracket means to said handle; and wherein said bracket means comprises identical halves, each of which includes a semi-circular portion and a hook portion, said semi-circular portion including locking means for locking said bracket means to said bracket sleeve, and said hook portion including hook means for attachment to said tool holder.

6. The apparatus of claim 5 wherein said hook means of said halves are attached to said tool holder and said semi-circular halves are collapsed to form a cylindrical unit, said cylindrical unit inserted into said bracket sleeve such that said locking means securely mates said tool holder to said handle.

7. The apparatus of claim 6 wherein said locking means includes at least one protrusion from at least one bracket half being inserted into a corresponding aperture in said bracket sleeve.

8. The apparatus of claim 7 wherein said at least one protrusion possesses spring resiliency such that said protrusion returns to its original configuration after depression and release.

9. Apparatus for renovating a drywall ceiling comprising:

ceiling tool means for working said ceiling;

a tool holder for interchangeably retaining said tool means;

handle means for a user to utilize said tool means;

attachment means for removable attachment of said tool holder to said handle, said attachment means including a sleeve portion for attachment to said handle and a bracket portion for attachment to said tool holder, said sleeve portion and said bracket portion having interlocking means for locking said sleeve means to said bracket portion; and said bracket portion comprises identical halves, each of which includes a semi-circular portion and a hook portion, at least one of said semi-circular portions including said interlocking means and each said hook portion including hook means for mating attachment to said tool holder.

10. The apparatus of claim 9 wherein said tool holder is of an elongated, hollow, substantially square configuration with generally square planar surfaces and includes longitudinal slot means in one of said surfaces for receiving said tool means; and tool retaining means for replaceably attaching said tool means to said tool holder.

11. Method for removing acoustical ceiling, and replacement with a textured ceiling comprising the steps of:

applying a fine spray of water to said ceiling area sufficient to loosen the acoustical ceiling;

providing a universal mating tool holder for interchangeably securing a scraping tool, debris broom, spreading knife and a drywall mud application pad;

attaching said scraping tool to said tool holder and removing the loosened acoustical ceiling with said scraping tool;

replacing said scraping tool with said debris broom and sweeping remaining debris from said ceiling with said broom;

replacing said debris broom with said spreading knife and spreading drywall mud to cover exposed flaws with said spreading knife; and replacing said spreading knife with said application pad and applying a new coat of drywall mud texture to the ceiling with said pad.

12. The method of claim 11 wherein said scraping tool, debris broom, spreading knife, and application pad each have hand-held extension means for enabling the user to work said ceiling while standing on the floor beneath said ceiling.

13. The method of claim 11 including the additional step of providing a protective envelope underneath said ceiling, around said work area, and over flooring underneath said ceiling prior to commencing work, and includes;

sticking first portions of strips of masking tape to selected spots as necessary at the extremities of said work area with second portions of each strip not stuck to said selected spots but left hanging toward the floor;

placing sheets of plastic of sufficient dimensions under respective hanging strips of tape and sticking them to the exposed adhesive sides of the said strips, said sheets arranged to provide protective walls for said work area; and placing additional plastic sheets as necessary to cover the flooring under said acoustical ceiling and connecting them to said additional sheets of plastic as necessary to provide a protective enclosure to isolate said acoustic ceiling and said work area.

14. The method of claim 11 wherein said application pad includes pattern means for providing a design to the textured ceiling.

* * * * *